US006141808A

United States Patent [19]

Akado

[11] Patent Number: 6,141,808

[45] Date of Patent: Nov. 7, 2000

[54] BED MAT TO BE USED FOR THE SICK

[75] Inventor: Koji Akado, Koshigaya, Japan

[73] Assignee: Akado Co., Ltd., Koshigaya, Japan

[21] Appl. No.: 08/929,533

[22] Filed: Sep. 15, 1997

[30] Foreign Application Priority Data

Apr. 7, 1997 [JP] Japan ..... 9-087912

[51] Int. Cl.[7] ..... A47C 20/02

[52] U.S. Cl. ..... 5/690; 5/722; 5/738

[58] Field of Search ..... 5/690, 695, 699, 5/722, 655.9, 657, 926, 632, 640, 419, 738, 729

[56] References Cited

U.S. PATENT DOCUMENTS

| | | | |
|---|---|---|---|
| 3,146,469 | 9/1964 | Slade | 5/695 |
| 3,574,873 | 4/1971 | Weinstein | 5/926 |
| 4,011,610 | 3/1977 | Parker | 5/695 |
| 4,628,557 | 12/1986 | Murphy | 5/699 |
| 4,706,313 | 11/1987 | Murphy | 5/722 |
| 5,136,741 | 8/1992 | Balonick et al. | 5/699 |

FOREIGN PATENT DOCUMENTS

| | | |
|---|---|---|
| 1-85650 | 3/1989 | Japan . |
| 4-215757 | 8/1992 | Japan . |
| 7-8522 | 1/1995 | Japan . |

*Primary Examiner*—Terry Lee Melius
*Assistant Examiner*—Fredrick Cowley
*Attorney, Agent, or Firm*—Faegre & Benson LLP

[57] ABSTRACT

A mat member is divided into a plurality of mat members and those divided mat members are individually wrapped in a middle bag respectively, to form middle mats 7 and 8 and these middle mats 7 and 8 are adjacently wrapped in an outer bag to form a finished mat. Whereby, the middle mats 7 and 8 wrapped in the outer bag 9 are individually separated, which is made easily to take out and accommodate in the outer bag and causes to lighten the burden of a nurse for removing or putting the finished mat, and since the finished mat comprises the middle mats wrapped in double i.e. in middle bags individually and in an outer bag, any excreta is not penetrated to the mat members, by which instant cleaning of the finished mat can be carried out to lighten the burden of the sick and the nurse.

3 Claims, 4 Drawing Sheets

BED MAT TO BE USED FOR THE SICK

BACKGROUND OF THE INVENTION

1. Field of the Invention

This invention relates to an improvement of a bed mat to be used for a sick person (hereinafter referred to "the sick").

2. Prior Art

As a bed mat to be used for the sick, for an instance, there have been what is disclosed in Japanese Patent Laid-open publication No. Hei 7-8522. In the bed mat to be used for the sick disclosed in that publication, a mat member is divided in two lengthwisely, each of the divided bags is separately wrapped in an outer bag respectively to form middle mats, which are adhered through a magic tape (a trade name) fastened to the facing surface of the outer bag to form a bed mat to be used for the sick (hereinafter referred to "finished mat"). Since the finished mat is divided lengthwisely, when helping for the sick to move for taking a bath or replacing the mat used, the sick is moved from one of middle mats by turning over to another middle mat and the one mat is released from another mat by releasing the magic tape and taking off it, and the sick is moved to the another mat by turning over. Thereby, the sick who lay on one finished mat can be made lain on the floor where the finished mat has been taken away. Thus, it may greatly lighten the burden of a nurse or female nurse (hereinafter referred to "the nurse") at the time such as when a finished mat being replaced or the sick taking a bath.

In a conventional finished mat of such as mentioned above, since its divided surfaces have been adhered or connected using a magic tape (a trade name), the following problems to be improved reside, that is, since the lengthwise dimension of a finished mat is approximately 2 m, it is inconvenient in handling it i.e. to release one divided mat having such dimension from another half because the finished mat is to be handled with a strong power. Further, although it is thinkable to divide the mat into several pieces of middle mats, to be wrapped with outer bags respectively and connected with connectors, it is time-consumed to take processes at every time to connect or disconnect them. Further, when making easy for the divided mat to be released from connecting surface, an easy releasing of the mat may occur while the sick is lying on the mat, and when it happens, it may be uncomfortable to the sick which causes for the sick to take an unexpectable burden.

Further, since the member of the mat is merely wrapped with outer bag, there can be the following problems to be improved. Usually, a finished mat is covered with a sheet to avoid it from dirtying, the sick such as a bedridden old man excretes sometimes while lying on the bed. In such case, the outer bag happens to dirty through the sheet. Then, the outer bag is removed from the mat member to clean it, but the surface of the mat member is not smooth or slidable, so that there can be a problem difficult to take out the mat member from the outer bag. Further, if such excreta is penetrated in the mat, since it is quite difficult to clean it and take a time to dry it, the sick may endure an unexpected burden.

The present invention is to provide a finished mat which may avoid the excreta from being penetrated, enable to be cleaned for a short period of time, lighten the burden of the sick and the burden of the nurse to move the sick for replacing or prepare the mat.

A means recognized from the description of the claim 1 in order to solve the above problems is characterized in that, in a finished mat to be put on a bed for the sick, a mat member is divided in a plurality of middle mats, which are wrapped individually in a bag to form a middle mat respectively and those middle mats are combined in such a manner as those form a finished mat together by being wrapped adjacently in an outer bag.

Next, a means recognized from the description of the claim 2 is characterised in that said middle mat is made of a material which presents a sliding property.

Next, a means recognized from the claim 3 is characterized in that said middle mat is made of a material which presents sliding property and is processed for bearing a water-repellant property.

Further, according to the means described in each of the claims, it is explained how the above problems to be solved. First, in the invention recognized from the claim 1, the member of a mat is divided into a plurality of middle mats, which are individually wrapped in a middle bag to form middle mats, and those middle mats are combined adjacent to each other and wrapped in an outer bag to form a finished mat, whereby middle mats in the outer bag are independent individually and the finished mat is adapted to be wrapped in double by a plurality of middle bags and an outer bag.

Next, since, in the invention recognized from the claim 2, the middle bags are made of the material which presents a sliding property, the middle bags is smoothly taking out of the outer bag or accommodated in the outer bag.

Next, since, in the invention recognized from the claim 3, the middle bags are made of the material which presents a sliding property and is processed for bearing a water-repellency, the middle bags is smoothly taking out of the outer bag or accommodated in the outer bag and the penetration of excreta to the mat member is prevented.

Further, a manner of a practice of the present invention recognized from the above claims is explained. First, as the manner of the practice of the invention recognized from the claim 1, as shown in FIG. 5, a finished mat 2 to be put on a bed 1 for use of the sick is, as shown in FIGS. 3 and 4, divided into a plurality of mat members 3 and 5, and these mat members 3 and 5 are wrapped in middle bags 4 and 6 individually to form, as shown in FIG. 1, middle mats 7 and 8. And, as shown in FIG. 1, these middle mats 7 and 8 are combined adjacently and wrapped in an outer bag 9 to complete, as shown in FIG. 2, a finished mat 2 by unifying the middle mats 7 and 8.

Next, as the manner of a practice of the invention recognized from the above claim 2, the middle bags 4 and 6 shown in FIGS. 3 and 4 are made of a material which presents a sliding property.

Next, as the manner of a practice of the invention recognized from the above claim 3, the middle bags 4 and 6 shown in FIGS. 3 and 4 are made of a material which presents a sliding property and is processed for water-repellancy.

EMBODIMENT

Figure 1:
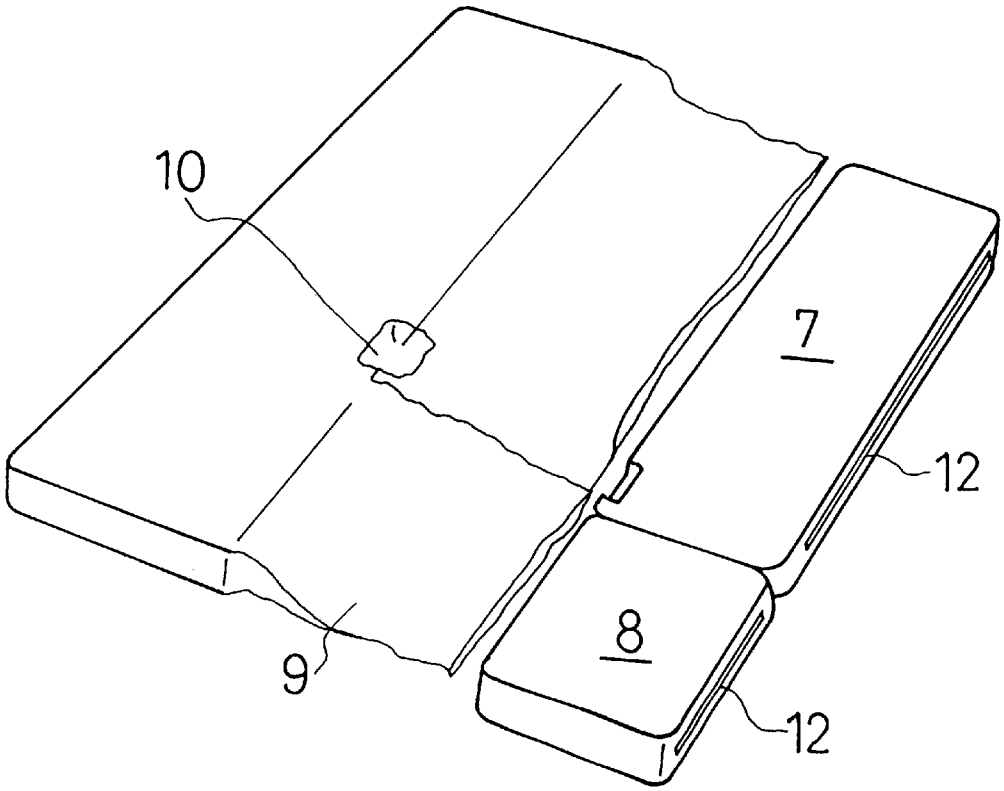
FIG. 1 is a perspective view of one embodiment of the present invention.
Figure 3:
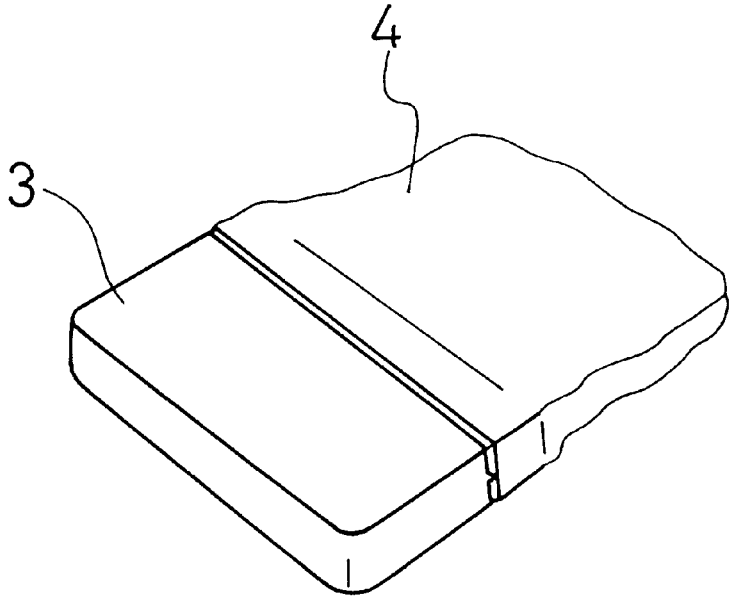
FIG. 3 is a perspective view of a state where a mat member is accommodated in middle bag to form a middle mat (back portion) of FIG. 1.
Figure 4:
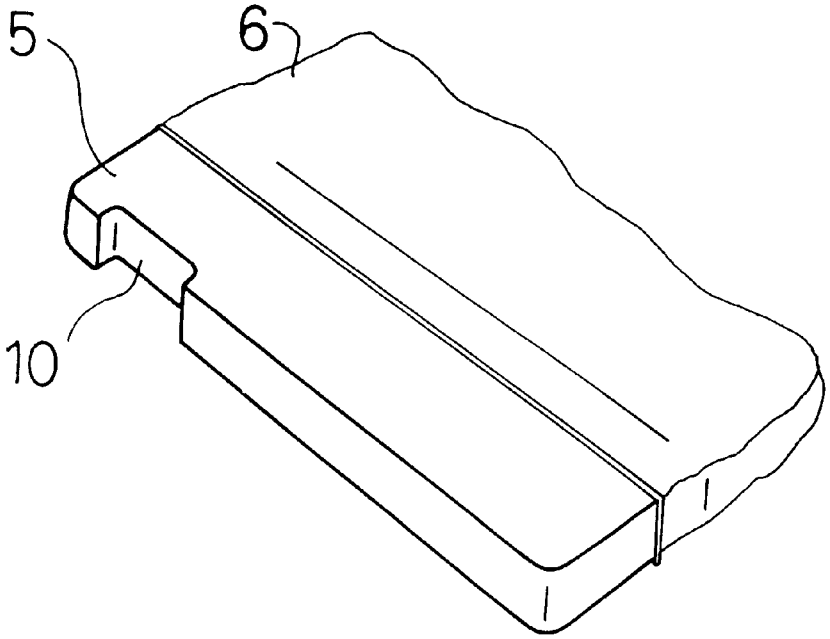
FIG. 4 is a perspective view of a state where a mat member is accommodated in a middle bag to form a middle mat (floor portion) of FIG. 1.

Hereinafter, one embodiment of the present invention is explained. Referring to FIG. 1, there shows an embodiment in which a mat member is divided into four. The mat members 3 and 5 shown in FIGS. 3 and 4 are processed by molding plastic such as a foam polyurethane. The mat members 3 and 5 shown in FIGS. 3 and 4 are wrapped individually in middle bags 4 and 6 to form, as shown in FIG. 1, middle mats 7 and 8. And, the middle bags 4 and 6 are excellent in sliding property and a material having a good air-permeability such as a cloth of a nylon processed in taffeta (nylon taffeta), and this middle bags 4 and 6 are processed in water-repellancy.

Or, since these middle mats 7 and 8 are wrapped in an outer bag 9 and the surfaces of the middle bags 4 and 6 do not contact to the skin of the sick, the bags 4 and 6 may be made from vinyl. Thereby, the penetration of such as excreta to the mat members 3 and 5 is securely prevented and the glide property of the bags is excellent. In addition, the middle mats 7 and 8 are divided and have air-permeability, and since an air layer is made between the middle bags 4, 6 and the outer bag 9, even though vinyl is used as the middle bags 4, 6, no trouble for permeability occurs and the air layer contributes to keep temperature.

In FIG. 1, the middle bags 4 and 6 are sewed in accordance with the configuration of the mat members 3 and 5. However, when these bags 4 and 6 are made a little larger, it becomes easier in in-out-operation of the mat member in the bags and it can make use of the spaces kept in the bags 7 and 8 as a stuff between mating surfaces of the middle mats 7 and 8, 7 and 7, 8 and 8, so that when the middle mats wrapped in middle bags are accommodated in the outer bag 9, a contact feeling of the mating surfaces from outside may be disappeared. Also, the outer bag 9 may be processed for water-repellency. In that case, the mat members are water-proofed in double i.e. by the outer bag 9 and the middle bags 4 and 6, so that the penetration of excreta into the mat members 3 and 5 will be prevented securely.

Figure 2:
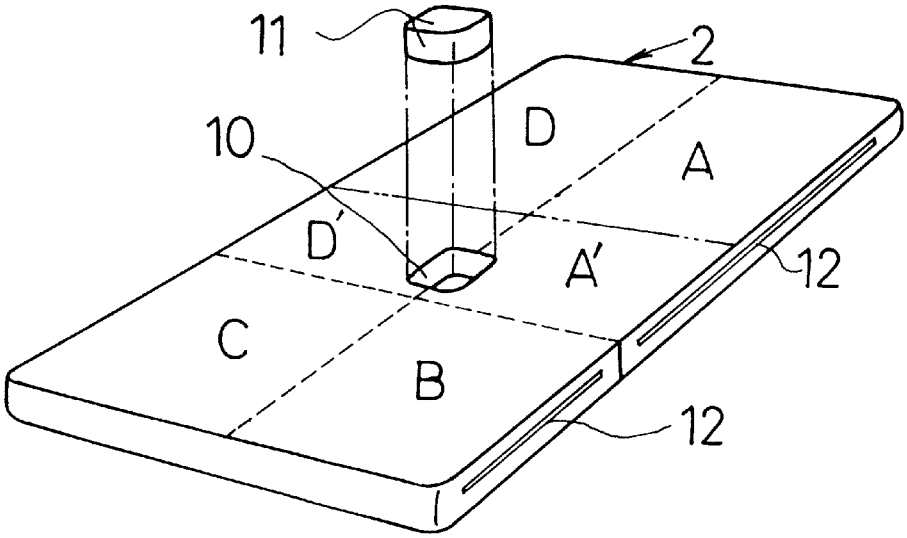
FIG. 2 is a perspective view of a finished mat stuffed with middle mats of FIG. 1 in an outer bag.
Figure 5:
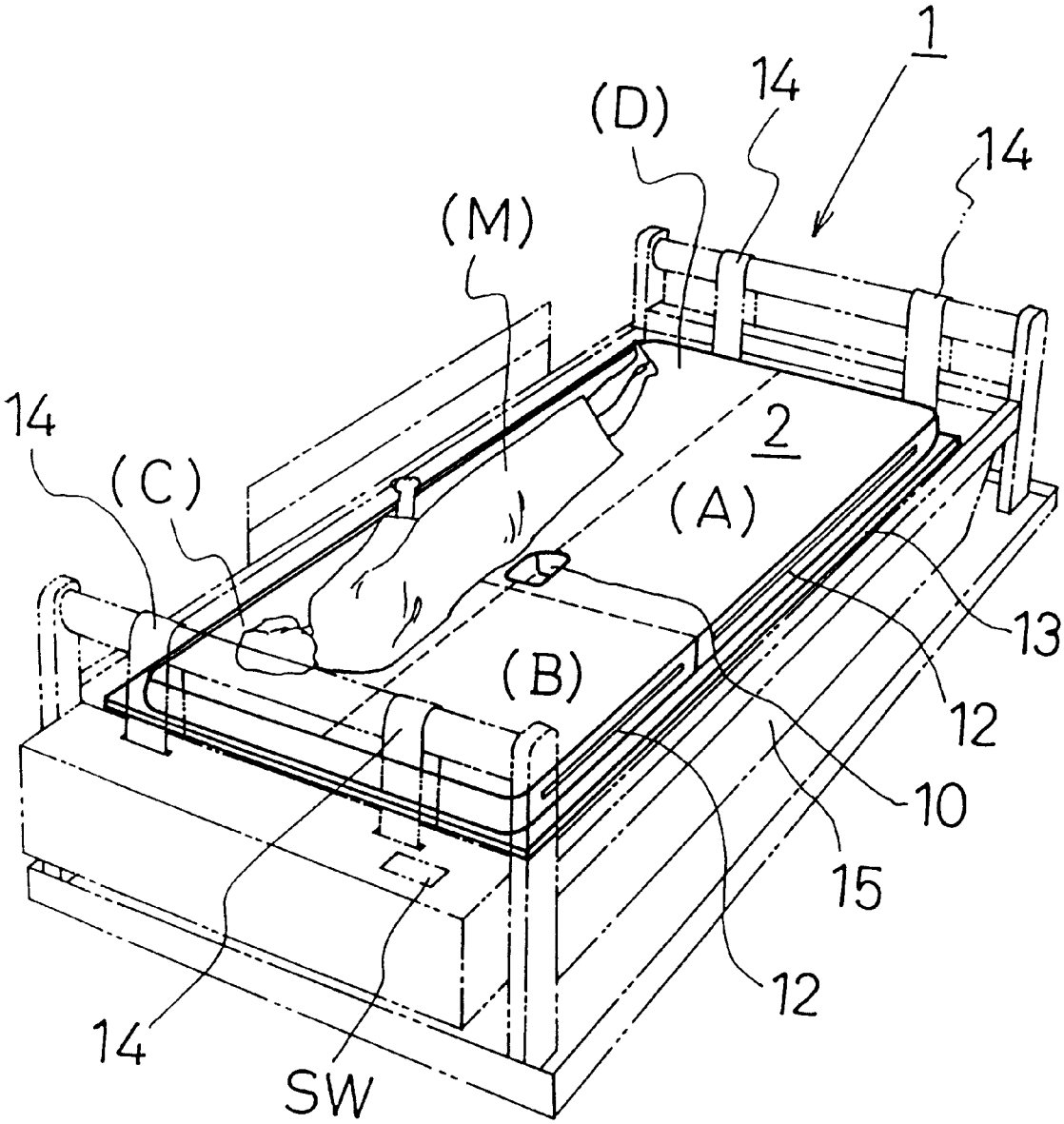
FIG. 5 is a perspective view of a state where a finished mat of FIG. 1 is used for a bed for use of the sick.

In FIGS. 1, 2 and 5, it is shown that the finished mat 2 is provided with an excretion outlet 10 for the sick to be able to excrete while lying on the bed. Further, if the sick can do himself by the help of the nurse, the excretion outlet 10 is not necessary, then a cover 11 for the outlet 10 is provided as shown in FIG. 2. And, as shown in FIG. 1, the middle bags 4 and 6 are provided with fasteners 12, through which and the mat members 3 and 5 can be adapted to be inserted in or drawn out of the bags.

Figure 6:
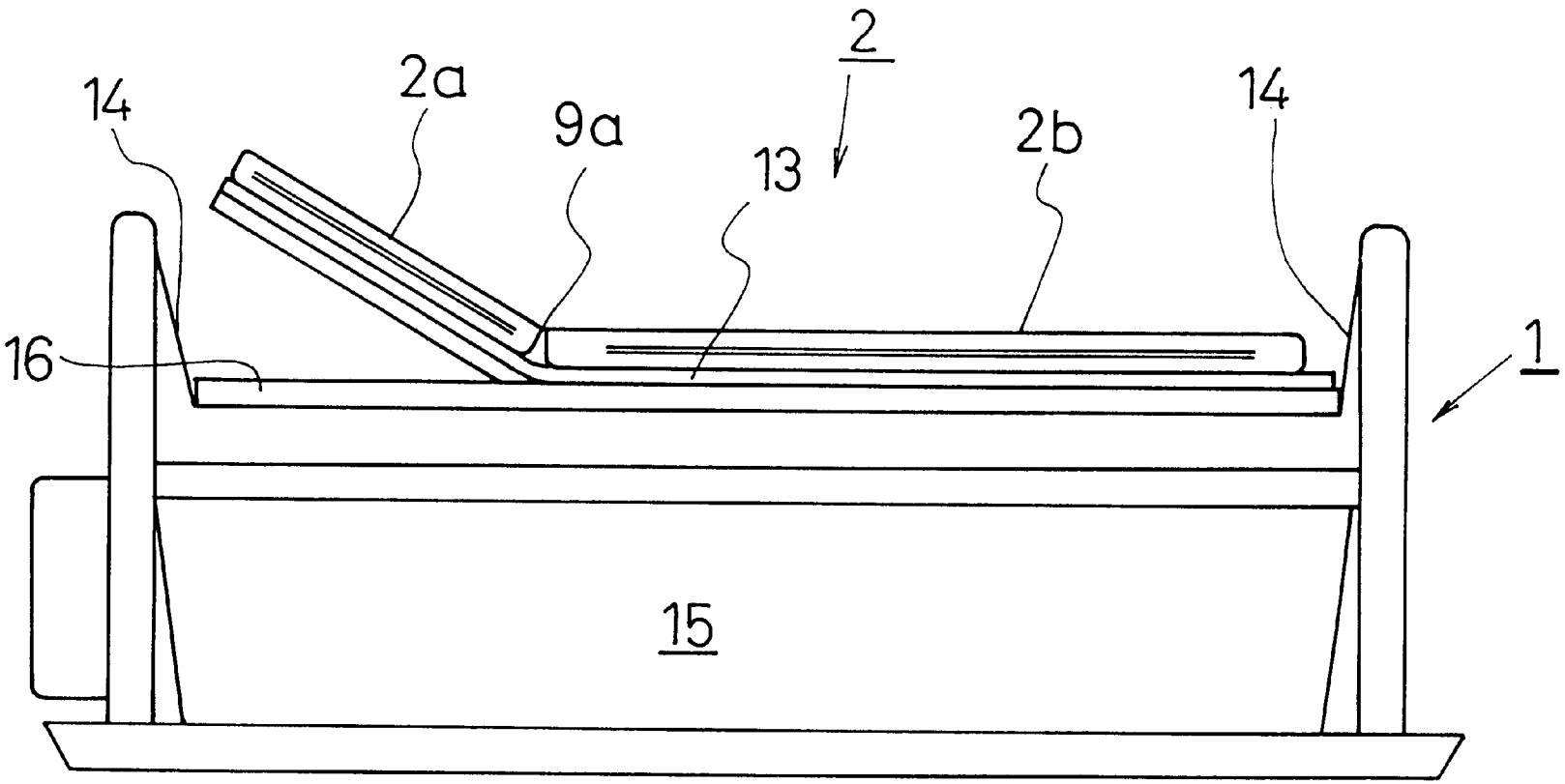
FIG. 6 is a perspective view of a state where a finished mat of FIG. 1 is made to raise to set up the upper half of the body of the sick.

Further, as shown in FIG. 2, the outer bag 9 is also provided with a fastener 12, which are on both sides of the outer bag 9, thereby from both sides the middle mats 7 and 8 can be adapted to be inserted in and drawn out of the outer bag 9. As shown in FIG. 6, the finished mat 2 consists of the upper side 2*a* (back portion)i.e. which contacts to the back of the sick and the bottom side 2*b* (floor portion) i.e. which contacts to the floor, in which the back portion 2*a* is adapted to be raised at a given angle. In order to enable for the back portion 2*a* to raise, the outer bag 9 can be departed at the joint 9*a* keeping connected merely on the upper side (back portion 2*a*).

Next, the function of the present invention is explained. First, as to the penetration of the excreta, since, as shown in FIGS. 3 and 4, the mat members 3 and 5 are inserted in the middle bags 4 and 6 to form the middle mats 7 and 8, and those middle mats 7 and 8 are inserted in the outer bag 9 to form the finished mat 2, the mat members are wrapped in double with the middle bags 4, 6 and the outer bag 9, the excreta may be prevented from being penetrated in the mat members 3 and 5.

Further, when, in particular, treated for water-proof, the penetration to the mat members 3 and 5 may be securely prevented. And, by structuring in double as mentioned above, even though vinyl is used for the middle bags 4 and 6, since the feeling of the vinyl bag is not sensitive to the sick due to the outer bag 9, as the middle bag a vinyl bag can be used, thereby the penetration of the excreta to the middle bags 4 and 6 may be securely prevented.

Next, the function when replacing or putting the mat by moving the sick is explained. In FIGS. 3 and 4, the mat members 3 and 4 are accommodated in the middle bags 4 and 6 to form the middle mats 7 and 8 of FIG. 1, and further these middle mats 7 and 8 are accommodated in the outer bag 9 to form the finished mat 2, so that these middle mats 7 and 8 accommodated in the outer bag 9 are not connected each other but separated independently, and can be taken out easily from the outer bag 9 and reversely accommodated.

And, by employing a material which presents a sliding property (vinyl is also slidable) as the middle bags 4 and 6, since the middle mats 7 and 8 are separated independently in the outer bag 9, it can be easily carried out to take out these middle mats 7 and 8 from the outer bag 9 or accommodate them.

Explaining the practicing manner referring to FIGS. 5 and 6, for instance in the case where the sick M takes a bath, after making the sick M turn over on the middle mats C and D divided as shown, the fastener 12 is opened and the middle bags A and B are taken out from the outer bag 9. When taking out, since the middle mats A and B are separated and become small, and the middle bags 4 and 6 are slidable each other, it can be carried out easily to take out the middle bags.

Next, after taking out the middle mats A and B, the outer bag 9 is pulled the vacant portion of the outer bag 9 to the side of the middle mats C and D and make the sick M turn over reversely to move the sick M on a base mat 13 and remove the outer bag 9 as it contains the middle mats C and D to lay the sick M on the base mat 13.

And, as shown in FIG. 6, after the back portion 2*a* of the finished mat 2 is made to raise to set up the upper half of the body of the sick, a switch SW for descending operation shown in FIG. 5 is pushed to lower a frame body 16 supported by a belt 14 in a bath 15 to make the sick take a bath while laying on the base mat 13. After taking a bath the frame body 16 is lifted to the original position and the base mat 13 and the sick are dried using warm blow, then the back portion 2*a* is returned to the horizontal, the middle mats C and D contained in the outer bag 9 are returned on the base mat 13 and make the sick M turn over to the middle mats C and D, then the outer bag 9 is extended on the base mat 13 and the middle mats A and B are accommodated in the outer bag 9, and finally the sick M is made to turn over. Thus, by merely repeating of turning over of the sick M the burden of the nurse may be lightened.

Further, as well as when cleaning the finished mat 2, while making the sick M turn over, the finished mat 2 can be removed from the base mat 13. And usually, the finished mat 2 is covered with a sheet, which may be cleaned or replaced, however, when the sheet is penetrated by some excreta and the outer bag 9 is dirtied the middle mats 7 and 8 are to be taken out from the outer bag 9 and the outer bag 9 may be cleaned.

Further, when the middle bags 4 and 6 are also dirtied by the penetration of the excreta, since the excreta does not penetrate the mat members 3 and 5, the penetrated excreta can be wiped away from the middle mats 7 and 8.

In addition, since the finished mat 2 are constructed in double with the outer bag 9 and the middle bags 4 and 6, the sick may not contact to the middle bags 4 and 6 directly, and merely wiping the dirtied middle bags 4 and 6 may be sufficient. Further, since the middle mats 7 and 8 are divided small, merely cleaning the dirtied middle mats. For instance, the excreting outlet 10 which is most likely to be dirtied may be divided, as shown in FIG. 2, into middle mats A' and D', only which may be cleaned. Whereby, the burden of the nurse may be more lightened.

The above explanation has been done concerning the cases where the mat is divided into four or six, however, in consideration of the material which presents an easy sliding property for the middle bags 4 and 6, of the point in which the middle bags are easily to be taken out or accommodated in the outer bag 9, of the point in which the middle mats 7 and 8 are divided small and made easily taken out or accommodated in the outer bag 9 and of the point where the cleaning is made easily to be carried out, it will be functioned as well as in a case, where the mat member is divided lengthwisely in two.

According to the invention recognized from the description of the detailed explanation based on the claim 1, since a mat member is divided into a plurality of middle members, these mat members are wrapped individually in middle bags and those middle bags are combined and wrapped in an outer bag to form a finished mat, in which each of the middle mats wrapped in the outer bag is respectively separated, the middle mats are easily to be taken out or accommodated in the outer bag, whereby the burden of the nurse who has to remove or put the mat while moving the sick is lightened, and since the mat members are wrapped in double i.e. in middle bags and outer bag, any excreta may not be penetrated to the mat members, the mat can be instantly cleaned, which does not cause the sick to be troubled and lightens the burden of the nurse.

Next, according to the invention recognized from the detailed explanation, based on the description of the claim 2, the middle bag is made from a material which presents a sliding property, and since it is made easily to be taken out and accommodated in the outer bag, whereby it can be carried out to remove or put the mat while keeping the sick to move.

Next, according to the invention recognized from the detailed explanation, based on the description of the claim 3, since the middle bag is made from a material which presents a sliding property and is processed for water-repellancy, and the excreta is prevented from being penetrated to the mat members, it becomes easy to take out or accommodate the middle mats in the outer bag, the burden of the nurse to remove or put the mat while keeping the sick to move is lightened, and no excreta is penetrated to the mat members and instantly the cleaning of the mat is carried out to avoid the inconvenience of the sick and as well as lighten the burden of the nurse.

What is claimed is:

1. A bed mat for use of the sick comprising a mat having a longitudinal dimension for being put on a bed frame, which comprises a plurality of divided mats, wherein the divided mats are wrapped in middle bags respectively and are arranged to form at least a plurality of middle mats having sides that are positioned adjacent to and separated from one another by a longitudinally extending line of separation and only the middle mats are wrapped in a unit inside a cavity of an outer bag, wherein the outer bag has a closeable opening on a side such that the middle mats can be laterally inserted into and laterally drawn out of the outer bag through the closeable opening.

2. A bed mat for use of the sick according to the claim 1, wherein said middle bags are made of a material which enhances the ability of the middle mats to slide within the outer bag when the middle mats are laterally inserted into and laterally drawn out of the outer bag.

3. A bed mat for use of the sick according to the claim 1, wherein said middle bags are made of a material which enhances the ability of the middle mats to slide within the outer bag when the middle mats are laterally inserted into and laterally drawn out of the outer bag and is processed for water-repellency.

* * * * *